US007071881B1

(12) United States Patent
McKinley et al.

(10) Patent No.: US 7,071,881 B1
(45) Date of Patent: Jul. 4, 2006

(54) CIRCULAR ANTENNA POLARIZATION VIA STADIUM CONFIGURED ACTIVE ELECTRONICALLY STEERABLE ARRAY

(75) Inventors: William S. McKinley, Clermont, FL (US); Jeffrey A. Dean, Clermont, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/958,964

(22) Filed: Oct. 4, 2004

(51) Int. Cl.
*H01Q 1/24* (2006.01)

(52) U.S. Cl. ..... 343/700 MS

(58) Field of Classification Search ..... 343/700 MS
See application file for complete search history.

(56) References Cited

U.S. PATENT DOCUMENTS

| | | | | |
|---|---|---|---|---|
| 5,781,158 | A * | 7/1998 | Ko et al. | 343/700 MS |
| 5,815,119 | A * | 9/1998 | Helms et al. | 343/700 MS |
| 6,014,114 | A * | 1/2000 | Westfall et al. | 343/846 |
| 6,292,143 | B1 * | 9/2001 | Romanofsky | 343/700 MS |
| 6,930,639 | B1 * | 8/2005 | Bauregger et al. | 343/700 MS |

* cited by examiner

*Primary Examiner*—Tho Phan
(74) *Attorney, Agent, or Firm*—Jeffrey D. Myers; Timothy D. Stanley; Peacock Myers, P.C.

(57) ABSTRACT

An apparatus for (and method of) generating circular antenna polarization (from a planar structure encompassing the feed, excitation, and antenna functions), consisting of a plurality of modules each comprising one or more patch antennas, wherein at least one or more of the modules is stacked atop one or more other modules to form a stair-stepped, stadium like antenna array.

19 Claims, 3 Drawing Sheets

CIRCULAR ANTENNA POLARIZATION VIA STADIUM CONFIGURED ACTIVE ELECTRONICALLY STEERABLE ARRAY

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to circular antenna polarization for radio detecting and ranging (RADAR) applications, particularly in conjunction with active electronically steerable arrays (AESAs).

2. Description of Related Art

In the lower portion of the RF spectrum (Ku-band and below), coaxial and wave guide connections dominate the RADAR interconnectivity scheme. However, as RADAR system development is pushed into millimeter wave (mm-wave) frequencies and above, coaxial interconnection is no longer feasible while the form-factor associated with wave guide is often impractical for small integrated assemblies.

Therefore, one of the greatest challenges in miniaturizing RADAR module assemblies at mmWave frequencies is achieving a functional, low loss RF interface between the exciter, feed, and antenna networks (functions that usually exist in planes orthogonal to one another).

Circular polarization at mmWave has most recently been achieved by implementing difficult, low yield orthogonal RF transitions to make the interface between the module's planar RF exciter and feed circuitry (existing in the x-y plane) and antenna elements (existing in the y-z plane). These transitions have been achieved by employing relatively expensive and problematic specialty coaxial connections or fin-line transmission lines. Both techniques, however, have a relatively high degree of difficulty associated with manufacturing them while the coaxial technique is currently frequency limited to Ka-band and below.

A cross slot circularly polarized antenna has been proposed, but in addition to becoming impractically small at mmWave frequencies, it too requires an orthogonal RF transition and thus suffers from the same manufacturing difficulties.

BRIEF SUMMARY OF THE INVENTION

The present invention is an apparatus for (and method of) generating circular antenna polarization from a uniplanar structure. It consists of a plurality of modules each comprising one or more patch antennas, wherein at least one or more of the modules is stacked atop one or more other modules, each emitting electromagnetic radiation from the plurality of antennas. In the preferred embodiment, the one or more modules comprise one or more microstrip patch antennas, more preferably one or more dual fed microstrip patch antennas. The modules are stacked in a stair-stepped fashion. Each of the modules attaches to a common back plane and is interchangeable. Phase staggers are introduced between modules to steer emission of the electromagnetic radiation.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of an apparatus and method for achieving circular antenna polarization, utilizing a dual fed planar (x-y plane) microstrip patch antenna element in conjunction with a stair stepped (or "stadium seating") multi-element module configuration. Right hand and/or left hand circular antenna polarization can be achieved (as well as the constituent linear polarizations) from an AESA in a cost effective, high yield, and production compatible manner. The "stadium" configuration, in conjunction with the uniplanar layout, eliminates the previous difficulties associated with achieving RF transitions to antenna elements that previously resided in an orthogonal geometric plane than the primary RF Millimeter Microwave Integrated Circuit (MMIC), feed, and exciter circuitry. All of the previously problematic coaxial or fin-line transitions are eliminated.

The coplanar nature of the patch antenna elements of the invention, vis-à-vis a supporting module's RF circuitry, means that no orthogonal RF transitions are required. The antenna is fed directly by standard microstrip circuitry on the same x-y plane (and even the same substrate, if desired) as the module's typical exciter, feed, and DC circuitry. In addition to eliminating all manufacturing difficulties previously experienced, the overall RF power losses are also reduced providing enhanced system performance in both receive and transmit modes. Because of the dielectric properties of air, form factor, and frequency scaling of the invention (affecting the module height (z) and width (y) as a function of wavelength), the invention is useful for frequencies through approximately 100 GHz (the upper limited driven only by the height of the DC circuit components).

Figure 1:
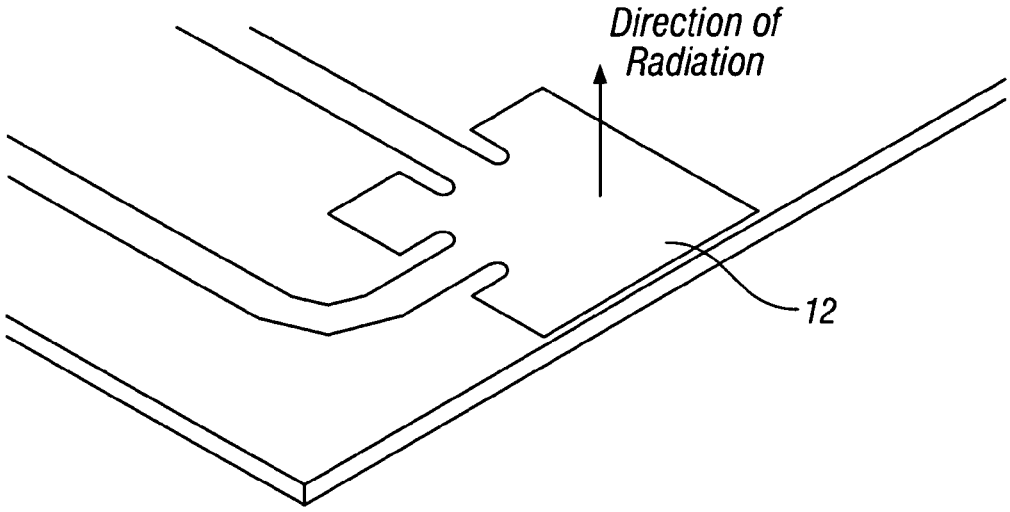
FIG. 1 is a perspective view of a dual fed patch antenna used in conjunction with the invention.

FIG. 1 is a perspective view of preferred single dual fed patch antenna 12 used in conjunction with the invention. The dual fed patch antenna provides the foundation for achieving both coplanar antenna functionality and circular polarization. Antenna radiation is normal (z) to the patch surface (x-y). The patch elements are preferred because they provide an antenna element function that provides dual polarization while existing on the same plane (x-y) as the feed and excitation networks. This eliminates the requirement for a costly and difficult plane transition network.

Figure 2:
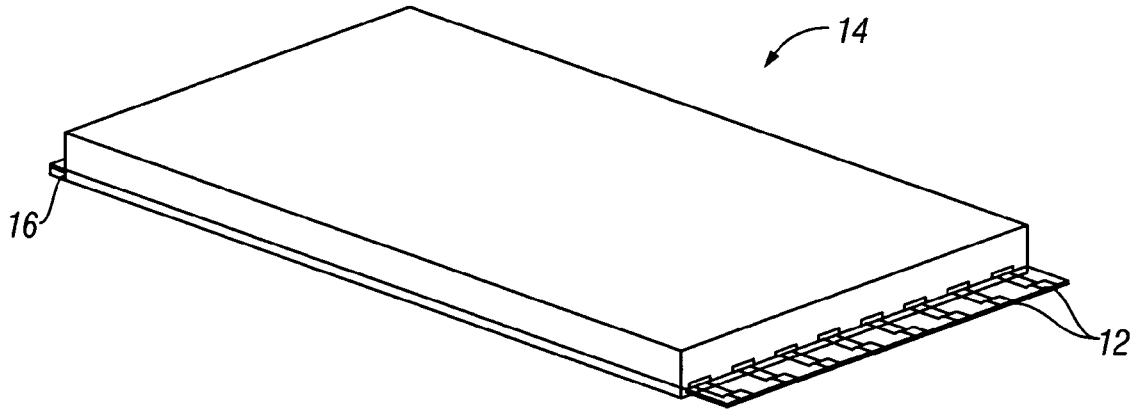
FIG. 2 is a perspective view of a single module of the invention employing a plurality of coplanar dual fed microstrip patch antennas.

FIG. 2 is a perspective view of a single multi-channel module 14 of the invention employing a plurality of coplanar dual fed patch antennas 12 in conjunction with a back plane interconnect 16. The number of patch antennas employed is a function of the desired overall module architecture, with the feed division of RF power typically defined as a binary function described as A*2^n (1, 2, 4, 8, etc.).

Figure 3:
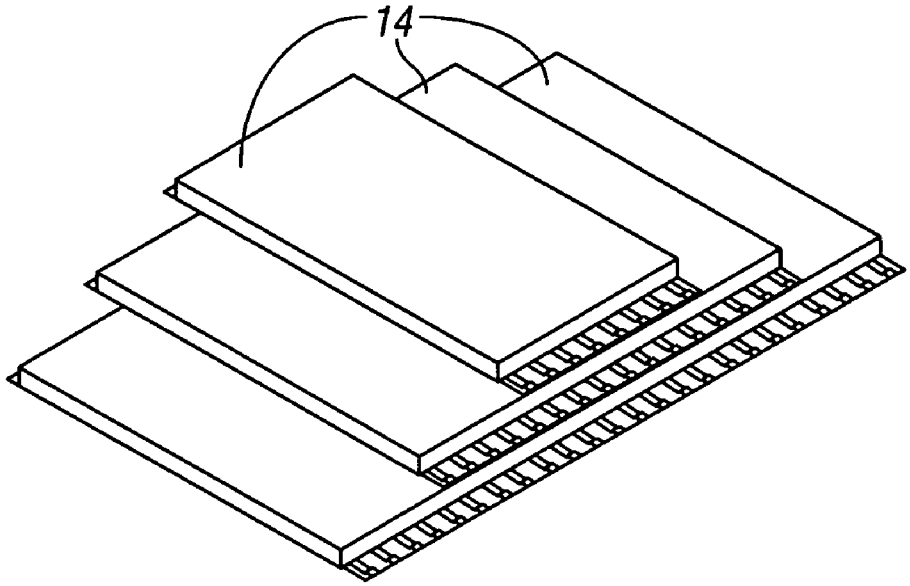
FIG. 3 is a perspective view of a plurality of modules of the invention in stacked configuration, with upper layers employing fewer patch antennas than lower layers.

FIG. 3 is a perspective view of a plurality of modules 14 of the invention in stacked ("stadium") configuration, with upper layers employing fewer patch antennas than lower layers. A back plane interface (not shown) is also preferably stepped to accommodate interchangeable modules 14. This stepped characteristic of the back plane also helps decrease interface complexity. The number of steps is also determined by the desired overall system or array level requirements. A single step to many steps may be required or desired (with more, less, or equal numbers of module above or below) depending upon the application and system requirements.

Figure 4:
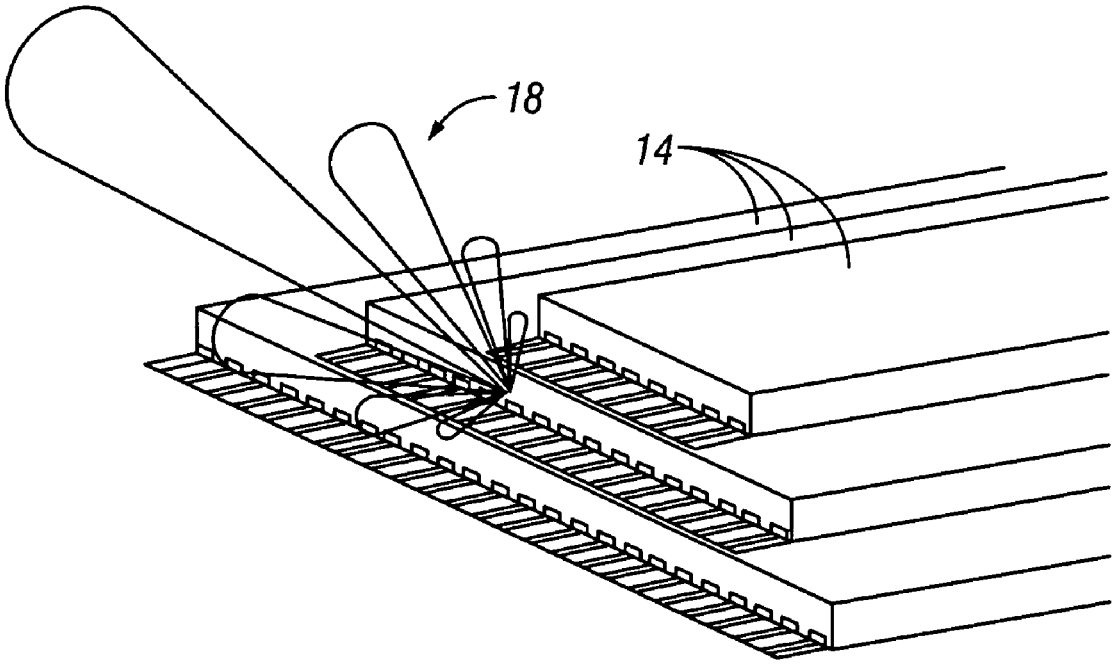
FIG. 4 is a perspective view of the invention illustrating a resulting antenna pattern.

FIG. 4 is a perspective view of the invention illustrating a resulting antenna pattern 18. As readily understood by one of ordinary skill in the art, phase staggers between each of the modules' individual channels alters the direction vector and shape of the lobe patterns in x, y, and z directions. It is well established in antenna theory that the beam of an array can be steered by changing the phases of the constituent elements appropriately. The desired difference in phase between elements is typically accomplished in excitation and feed networks.

Figure 5:
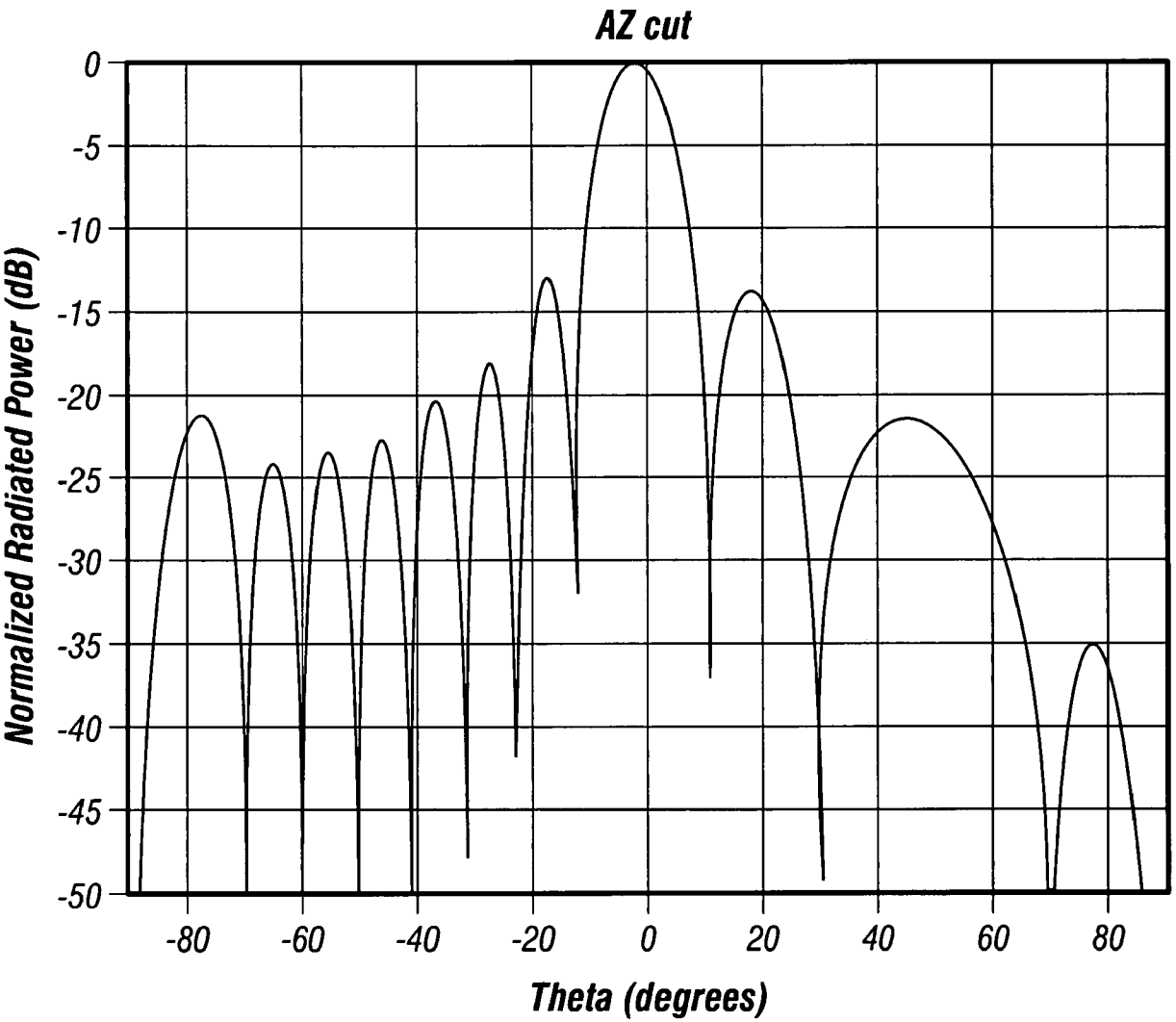
FIG. 5 is a graph of the radiated power of the invention as shown in FIGS. 3 and 4 as a function of angle in one polarization sense.

FIG. 5 is a graph of the radiated power of the invention as shown in FIGS. 3 and 4 as a function of angle. This pattern, typical of a multi-element array, represents the radiated power density as a function of angle off bore sight. As defined in the figure, the semi-circle (−90 degrees to +90 degrees) contains a power maximum, or main lobe, at zero degrees with other lobes existing throughout the semi-circle.

In addition to any AESA RADAR application, the invention is useful for any antenna system requiring a modular array of radiating elements at frequencies from approximately 1 to 100 GHz.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for achieving substantially circular antenna polarization, said apparatus comprising a plurality of modules each comprising one or more patch antennas, wherein one or more of said modules is stacked in a stair-stepped fashion atop one or more other of said modules to form a stair-stepped antenna array emitting electromagnetic radiation from the plurality of modules and wherein each level of modules contains fewer modules than levels below.

2. The apparatus of claim 1 wherein said one or more patch antennas comprise one or more microstrip patch antennas.

3. The apparatus of claim 2 wherein said one or more patch antennas comprise one or more dual fed microstrip patch antennas.

4. The apparatus of claim 3 wherein said one or more patch antennas comprise one or more dual fed planar microstrip patch antennas.

5. The apparatus of claim 1 wherein each of said modules attaches to a back plane.

6. The apparatus of claim 1 wherein each of said modules is interchangeable.

7. The apparatus of claim 1 wherein introduction of phase staggers between modules steers emission of electromagnetic radiation from said apparatus.

8. The apparatus of claim 1 wherein said apparatus radiates electromagnetic energy at frequencies of from approximately 1 GHz to approximately 100 GHz.

9. A method of generating circular antenna polarization, the method comprising the steps of:

providing a plurality of modules each comprising one or more patch antennas introducing phase staggers between modules to steer emission of the electromagnetic radiation, wherein one or more of the modules is atop one or more other of said modules to form a stair-stepped antenna array emitting electromagnetic radiation from the plurality of modules.

10. The method of claim 9 wherein the one or more patch antennas comprise one or more microstrip patch antennas.

11. The method of claim 10 wherein the one or more patch antennas comprise one or more dual fed microstrip patch antennas.

12. The method of claim 11 wherein the one or more patch antennas comprise one or more dual fed planar microstrip patch antennas.

13. The method of claim 9 wherein the plurality of modules are stacked in stair-stepped fashion.

14. The method of claim 13 wherein each level of modules contains fewer modules than levels below.

15. The method of claim 9 wherein each of the modules attaches to a back plane.

16. The method of claim 9 wherein each of the modules is interchangeable.

17. The method of claim 9 wherein the method radiates electromagnetic energy at frequencies of from approximately 1 GHz to approximately 100 GHz.

18. An apparatus for achieving substantially circular antenna polarization, said apparatus comprising a plurality of modules each comprising one or more patch antennas, wherein one or more of said modules is stacked atop one or more other of said modules to form a stair-stepped antenna array emitting electromagnetic radiation from the plurality of modules and wherein introduction of phase staggers between modules steers emission of electromagnetic radiation from said apparatus.

19. A method of generating circular antenna polarization, the method comprising the steps of providing a plurality of modules each comprising one or more patch antennas, wherein one or more of the modules is stacked in a stair-stepped fashion atop one or more other of said modules to form a stair-stepped, antenna array emitting electromagnetic radiation from the plurality of modules and wherein each level of modules contains fewer modules than levels below.

* * * * *

UNITED STATES PATENT AND TRADEMARK OFFICE

CERTIFICATE OF CORRECTION

PATENT NO. : 7,071,881 B1
APPLICATION NO. : 10/958964
DATED : July 4, 2006
INVENTOR(S) : William S. McKinley and Jeffery A. Dean It is certified that error appears in the above-identified patent and that said Letters Patent is hereby corrected as shown below:

On The Title Page, Item (75), Inventor "Jeffrey A. Dean" should read -- Jeffery A. Dean --.

Signed and Sealed this

Fifth Day of December, 2006

JON W. DUDAS
*Director of the United States Patent and Trademark Office*